US006702117B1

(12) United States Patent
Hould

(10) Patent No.: US 6,702,117 B1
(45) Date of Patent: Mar. 9, 2004

(54) BOX, OBJECT PACKAGING SYSTEM, AND METHOD OF USE

(75) Inventor: Jean-Francois Hould, Paris (FR)

(73) Assignee: L'Oreal S.A., Paris (FR)

( * ) Notice: Subject to any disclaimer, the term of this patent is extended or adjusted under 35 U.S.C. 154(b) by 4 days.

(21) Appl. No.: 09/908,589

(22) Filed: Jul. 20, 2001

(30) Foreign Application Priority Data

Jul. 20, 2000 (FR) ..... 00 09532

(51) Int. Cl.[7] ..... B65D 85/20
(52) U.S. Cl. ..... 206/446; 229/141; 229/152
(58) Field of Search ..... 206/395, 430, 206/446; 229/128, 130, 141, 152

(56) References Cited

U.S. PATENT DOCUMENTS

| | | | | | |
|---|---|---|---|---|---|
| 1,072,487 | A | * | 9/1913 | Morton | 229/152 |
| 2,027,488 | A | * | 1/1936 | Ness | 229/152 |
| 2,912,103 | A | * | 11/1959 | Hennessey et al. | 206/429 |
| 3,578,154 | A | * | 5/1971 | Martelli | 206/756 |
| 4,890,789 | A | * | 1/1990 | Lo Duca | 229/102 |

FOREIGN PATENT DOCUMENTS

| | | |
|---|---|---|
| AU | 314 417 | 4/1974 |
| DE | 93 18 993 | 2/1994 |
| EP | 0 318 750 | 6/1989 |

OTHER PUBLICATIONS

Patent Abstracts of Japan, vol. 1999, No. 8, Jun. 30, 1999 (JP 11 059655 A).

* cited by examiner

*Primary Examiner*—David T. Fidei
(74) *Attorney, Agent, or Firm*—Finnegan, Henderson, Farabow, Garrett & Dunner, LLP

(57) ABSTRACT

A box includes a front panel and a rear panel connected by side panels. The box further includes at least one opening and an associated closing system. The box may optionally contain an object whose cross-section is such that it is substantially in contact with at least one of the panels adjacent the opening. The closing system may include a lid part formed, for example, by folding a continuation of one of the panels. A flap may be formed from a continuation of the lid part, thereby allowing the flap to be positioned between the object and the front panel when the lid part is in a closed position. The flap may be provided with a free edge having outline configured to assist interposition of the flap between the object and the front panel. The box may be used for packaging a case such as a lipstick case.

64 Claims, 3 Drawing Sheets

BOX, OBJECT PACKAGING SYSTEM, AND METHOD OF USE

BACKGROUND OF THE INVENTION

1. Field of the Invention

The present invention relates to a box, an object packaging system, and a method of packaging an object using the box. The box may be of the type that includes a square or rectangular section body having a front panel and a rear panel connected by two or more side panels. The front, rear, and side panels may be produced by folding a sheet material such as board or other such material. The body of the box includes at least one opening and an associated closing system. The object contained in the box may have, optionally, a portion that is in contact with the front panel of the box. The invention may relate to the packaging of a lipstick case, which may have a cylindrical form, in a box that may be proportioned to the dimensions of the case.

2. Description of the Related Art

An example of a conventional device can be found in EP-A-0 318 750, which discloses a box in which the closing system includes two side tabs produced by folding the continuation of each side panel, with each side tab having a front edge situated nearest the front longitudinal panel. The box also includes a lid part produced by folding the continuation of a rear panel that is designed to be folded down over the side tabs. The lid part also includes a flap produced by folding the continuation of the lid part. The lid part thus exhibits a first edge connected to the rear panel and a second edge connected to the flap. During closing; the flap is intended to be inserted into a passage defined between the front panel of the box and the front edge of the side tabs. The side tabs are configured to overlap before the flap is inserted into the passage. The side tabs also have teeth for engaging a slot made in the fold between the flap and the lid.

With a box having the aforementioned configuration, difficulty may be encountered while attempting to insert the flap between the front face of the box and the object contained within the box when closing the lid part. This difficulty may be aggravated by the configuration of the object and the relative shape and dimensions of the box. setting, the difficulty may be increased further, especially if the object within the box is constrained from moving transversely within the box.

The above mentioned circumstances can frequently occur when the object to be packaged must be restrained from movement while contained within the box. An example of such a situation exists with the packaging of make-up products, for example, such as lipstick cases and similar products. These products are sometimes packaged in boxes with a certain amount of lateral and/or axial clearance. When such clearance exists, it is likely that the cases will rattle about inside the box during transport. If a case contains a stick of lipstick, the stick may become detached from its holder as a result of rattling about inside the box. Consequently, since a product such as lipstick has a relatively soft consistency, the product may become spoiled and unusable. Similar problems may also occur with other products, such as compacted make-up products.

Therefore, in order to prevent a case from rattling about inside the box, the dimensions of the box may be configured to closely fit the dimensions of the object being packaged. This provides a very simple and effective manner for securing the object within the box regardless of how the box is shaken or jolted such as may be encountered during transport.

However, when the box is configured to provide a close fit to the object it contains, once the object has been placed within the box, it can be very difficult to insert the free edge of the flap of the lid part into the box. With the object contacting the front panel of the box, often the flap abuts against the object instead of sliding between the object and the front panel of the box. Consequently, the flap is often damaged and the box cannot be closed properly.

An optional object of the present invention is to provide a box having dimensions that may approximate the dimensions of the object to be contained within the box in order to prevent substantially all movement of the object inside the box, and to provide a box that is simple to close.

Optionally, the invention may seek to provide a means that will enable a closing flap to be inserted easily between the front panel of a box and a corresponding portion of the object to be contained inside the box, where the insertion may be optionally performed by means of industrial tooling.

SUMMARY OF THE INVENTION

According to a first optional aspect of the invention, a box for packaging an object comprises a front panel defining a width, a rear panel, side panels connecting the front panel to the rear panel, at least one opening, and a closing system associated with the opening. The closing system may comprise a lid part defined by a folded continuation portion of the rear panel. The lid part may be configured to fold down over the opening when placed in a closed position. A flap may be defined by an uninterrupted fold line extending through at least a portion of the lid part located centrally between opposite sides of the lid part. The flap may be configured to be positioned between the object and the front panel when the lid part is in the closed position. The flap may also have a free edge having an outline configured to assist with interpositioning the flap between the object and the front panel.

According to a second optional aspect of the invention, a box for packaging an object comprises a front panel defining a width, a rear panel, side panels connecting the front panel to the rear panel, at least one opening, and a closing system associated with the opening. The closing system may optionally include a lid part defined by a folded continuation portion of the rear panel, wherein the lid part is configured to fold down over the opening when placed in a closed position. A flap may be defined by a folded portion of the lid part with the flap being configured to be positioned between the object and the front panel when the lid part is in the closed position. The flap may have a free edge including an outline configured to assist with interpositioning the flap between the object and the front panel. The box may also include at least one side tab defined by a continuation of one of the side panels and a fold line, where the side tab may have a side edge extending between the fold line and a terminal edge of the side tab. The side edge may be configured to be spaced from the front panel adjacent the terminal edge when the side tab is placed in a closed position. The flap may further be configured to be positioned between the side edge of the side tab and the front panel when the lid part is in the closed position.

Yet another optional aspect of the invention comprises an object packaging system including a box having a front panel defining a width, a rear panel, two side panels connecting the front panel to the rear panel, and at least one opening and an object contained within the box. The object may optionally have a cross-section substantially contacting the front panel adjacent the opening only at a contact portion defined by a portion of the width of the front panel. The object packaging system may also include a closing system associated with the opening, where the closing system may comprise a lid part defined by a folded continuation portion of the rear panel. The lid part may be configured to fold down over the opening when placed in a closed position. Further, a flap may be defined by a folded portion of the lid part, where the flap may be configured to be positioned between the object and the front panel when the lid part is in the closed position. The flap may optionally include a free edge having an outline configured to assist with interpositioning the flap between the object and the contact portion.

According to another optional aspect of the invention, the object packaging system may also include a flap having a free edge forming at least one extension configured to fit into a space formed between the object and the front panel and defined on at least one side of the contact portion. The extension may be located adjacent an edge portion defined by a progressively changing distance from the lid part, where the edge portion may be configured to progressively engage the object as the lid part is closed, and to further assist with the interpositioning of the flap between the object and the front panel.

An additional optional aspect of the invention may include an object packaging system wherein the object is substantially in contact with the front panel at only a central portion of the front panel, and the free edge forms two extensions separated by a distance greater than the width of the contact portion.

Yet another optional aspect of the invention may include an object packaging system wherein the cross-section of the object comprises at least one portion of an arc of a circle, with the object optionally being configured to be positioned in tangential contact with the front panel.

An additional optional aspect of the invention includes an object packaging system wherein the cross-section of the object is one of circular, oval, hexagonal, octagonal, and polygonal.

According to another optional aspect of the invention, the object packaging system may include a flap having two extensions being separated by an indentation having the form of one of a V-shape, a trapezium, and an arc.

Optionally, in another aspect of the invention, the object packaging system may have a flap including a free edge having an outline that extends progressively in a direction facing away from the lid part and toward an apex of each extension.

As an example of another optional aspect of the invention, the object packaging system may include a flap having a free edge including an outline having a convex shape.

An additional optional aspect of the invention may include an object packaging system having a closing system comprising at least one side tab defined by a continuation of one of the side panels. The flap of the closing system may be configured to be positioned between an edge of the side tab and the front panel when the lid part is in the closed position.

In an additional optional aspect of the invention, the object packaging system may include a case containing one of a make-up product and a care product.

In yet another optional aspect of the invention, the object packaging system may include a case containing one of lipstick, foundation, and lip-care product.

According to another optional aspect of the invention, the object packaging system may include a box formed from a sheet material.

In an additional optional aspect of the invention, the object packaging system may include a box formed from one of board, paper board, cardboard, and a paper-based material.

In another optional aspect of the invention, the object packaging system may include a flap having a free edge forming one extension configured to fit into a space formed between the object and the front panel, wherein the free edge curves progressively from a convex configuration to a concave configuration.

In yet another optional aspect of the invention, the object packaging system may include a second opening and a second closing system associated with the second opening. The second closing system may include a second lid part defined by a folded continuation portion of one of the panels, wherein the second lid part is configured to fold down over the second opening when placed in a closed position. The second closing system may also include a second flap defined by a folded portion of the second lid part where the second flap may be configured to be positioned between the object and one of the panels when the second lid part is in the closed position. The second flap may also have a free edge having an outline configured to assist with interpositioning the second flap between the object and one of the panels.

In another optional aspect of the invention, the object packaging system may include a second lid part defined by a folded continuation portion of the rear panel, and a second flap may have a free edge having an outline configured to assist with interpositioning the second flap between the object and the front panel.

In another additional optional aspect of the invention, a method of packaging an object may comprise providing an object packaging system according to any optional aspects of the invention, and further including inserting the flap between the object and the contact portion.

In an additional optional aspect of the invention, a method of packaging an object may include providing a case containing one of a make-up product and a care product.

In another optional aspect of the invention, a method of packaging an object may include providing a case containing one of lipstick, foundation, and lip-care product.

According to another optional aspect of the invention, a method of packaging an object may include providing an object packaging system according to any optional aspects of the invention, inserting a flap between the object and the contact portion, and further inserting a second flap between the object and one of the panels.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate optional embodiments of the invention and, together with the description, serve to explain some principles of the invention. In the drawings.

DESCRIPTION OF EMBODIMENTS

Figure 1:
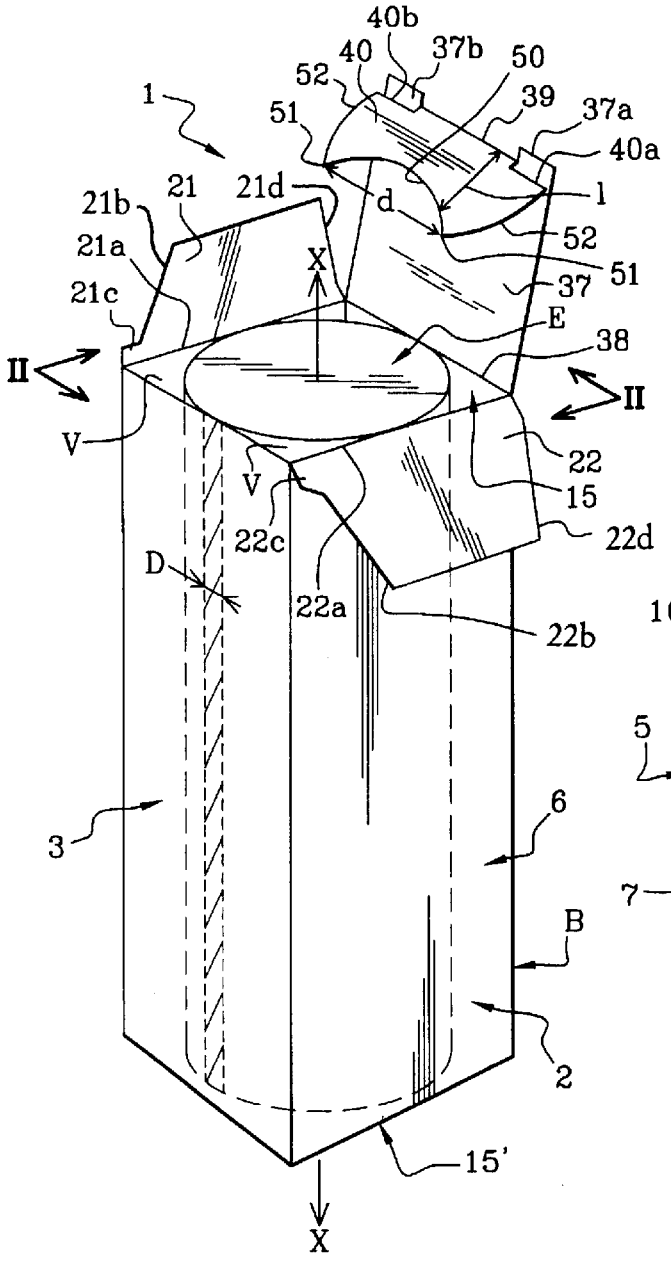
FIG. 1 is a schematic perspective view of an optional embodiment of an object packaging system according to an optional aspect of the invention.
Figure 2:
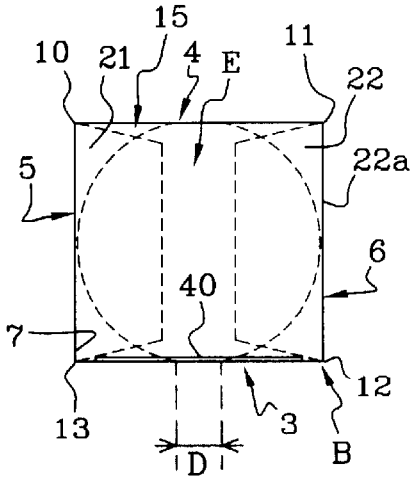
FIG. 2 is a schematic top view of the packaging system of FIG. 1.
Figure 3:
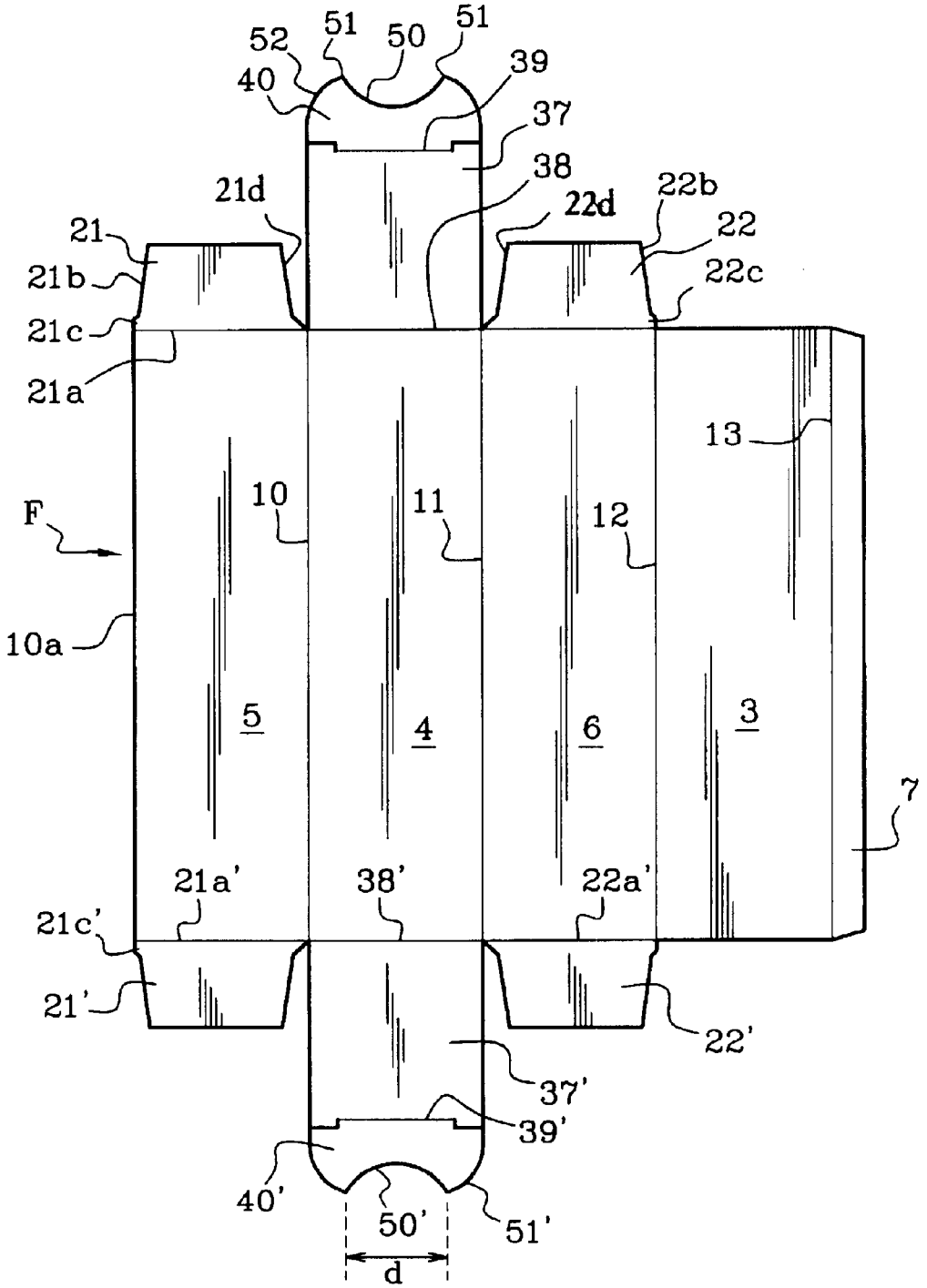
FIG. 3 is view prior to assembly of optional material used to form the object packaging system of FIG. 1.

An assembly 1 in accordance with an optional embodiment of the invention is illustrated in FIGS. 1 and 2, which show a box B into which a case E of a product such as lipstick may be inserted. The box B may be produced by folding and cutting, as illustrated in FIG. 3, a blank F made from a sheet material, for example, board, paper board, cardboard, paper-based material, or other suitable material, which may be optionally plastic-coated and/or decorated externally. An optional joining strip 7 may be produced along the lateral side of the front panel 3.

This optional joining strip 7 may be pasted to a side tab 5 to form a body 2 after the blank F has been folded around the exemplary fold lines 10, 11 and 12, which may optionally be parallel, separating the rear panel 4 from the left side panel 5, the right side panel 6 from the rear panel 4, and the front panel 3 from the side panel 6, respectively.

The optional joining strip 7 may be connected to the front panel 3 by a fold line 13 that may be parallel to the abovementioned fold lines 10, 11 and 12, thus forming an exemplary parallelepiped sheath 2. It is contemplated that various optional methods of connecting the panels together may be used, such as, but not limited to, snaps, hook and loop fasteners, a slot and tab connection, a butt joint connection, separate male and female connectors, or any equivalent structure.

In the example illustrated, the sheath 2 of the box includes an upper opening 15 and a lower opening, not visible in FIG. 1, and an exemplary closing system 21, 22, 37, 40 associated with the upper opening 15, and a similar exemplary closing system 21', 22', 37', 40' (FIG. 3) associated with the lower opening.

The exemplary closing system 21, 22, 37, 40 may include two exemplary side tabs 21 and 22, optionally produced from continuations of the side panels 5 and 6, respectively, and a lid part 37, optionally produced from a continuation of the rear panel 4, between the exemplary side tabs 21 and 22.

The lower closing system 21', 22', 37', 40' may include two optional side tabs 21' and 22' that may be formed from continuations of the side panels 5 and 6, respectively, and a lid part 37', optionally formed from a continuation of the rear panel 4. However, the upper closing system 21, 22, 37, 40 in accordance with an exemplary aspect of the invention need not be the same as the lower closing system 21', 22', 37', 40'.

Each optional side tab 21, 21' or 22, 22' may be connected to one of the associated side panels 5, 6 along a fold line 21*a*, 21*a'*; 22*a*, 22*a'*, which may be perpendicular to the fold lines 10 to 13 (FIG. 3).

On either side of the associated fold line, each side tab 21 or 22 may have side edges 21*b*, 22*b*; 21*d*, 22*d* cut obliquely to give the tabs 21, 21' or 22, 21' an optional trapezium shape. Near the fold line 21*a*, 21*a'*; 22*a*, 22*a'* and in the vicinity of the front panel 3, each tab 21, 21' or 22, 22' may have a protrusion 21*c*, 21*c'*; 22*c*, 22*c'*.

The lid parts 37, 37' may be connected to the rear panel 4 along a first fold line 38, 38'. A second fold line 39, 39' may run along the opposite side to the first fold line 38, 38', connecting each lid part 37, 37' to a closing flap 40, 40'. This exemplary flap 40, 40' may be designed to fit immediately behind the top end of the front panel 3 after the box B is closed.

According to an exemplary aspect of the invention, the free edge of each flap 40, 40' may be provided with a concave indentation 50, 50' which, in the example considered, is in the form of an arc of a circle. On either side of the indentation 50, 50', the side edges 52 of each flap 40, 40' may have a rounded shape, thus defining, in combination with the exemplary indentation 50, 50', two relatively pointed extensions 51, 51'. The optional extensions 51, 51' may be separated from one another by a distance d. With the optional configuration as described, the extensions 51, 51' may be separated by an edge portion situated at a progressively varying distance l from the corresponding fold line 39. This distance l may optionally pass through a minimum value halfway between the two extensions 51, 51'.

Additionally, each flap 40, 40' may include a step 40*a*, 40*b* on each side, slightly offset relative to the second fold line 39, 39', thus defining protruding tongues 37*a*, 37*b*. In this optional configuration, when the box B is in the closed position, these tongues rest on the upper (or lower) edge of the front panel 3. At the same time, the steps 40*a*, 40*b* receive the projecting portions 21*c*, 21*c'*; 22*c*, 22*c'*, thus consolidating the closure of the box B.

The object E to be packaged, according to FIG. 1, may optionally be a case of lipstick forming a cylinder of revolution. Alternatively, the object E could be a case containing a different make-up product, such as foundation, or a care-product, such as lip-care product. The height of the box B may correspond approximately to the height of the exemplary object E. The width of the side walls in this example is such as to substantially prevent sideways movement of the case E, resulting in reduced movement of the case E within the box B, such as during transport. As a result, the exemplary case E is in essentially tangential contact with the center of each of the four faces of the box B of this example.

An area of contact between the exemplary object E and the front face 3 is represented by reference D in FIG. 1.

The contact area D may extend from top to bottom in the middle part of the front panel 3. The width of the area of contact depends on the radius of the cross section of the object E. An example of this width might, for some cylindrical cases of lipstick, range from about 2 mm to about 4 mm. On either side of the contact area D, there may be defined two volumes V, bounded by the exterior of the object and by internal portions of the box not in contact with the object.

After the case E such as shown is placed in the exemplary box B, the optional side tabs 21 and 22 are placed in the opening 15, as illustrated in FIG. 2. Thereafter, the lid part 37 is folded down over the side tabs 21 and 22 and the exemplary flap 40 is inserted between the upper portion of the object E and the upper portion of the front panel 3.

If the free edge of the flap 40 were not to include the exemplary indentation 50, during insertion of the flap 40, the free edge would butt against the top end of the case in contact with the interior surface of the front panel. In this situation, and particularly when the box is being closed by an optional automated device, the edge of the flap would become damaged, rendering it difficult to properly close the box.

According to one optional embodiment of the invention, during insertion of the flap 40 into the sheath 2, the two extensions 51 each engage in the volumes V on either side of the contact area D. Because the interval d formed between the extensions is greater than the width of the contact area D, this step of the packaging process may be easy to perform. In the course of the movement of the flap 40 towards the closed position, the edge of the indentation 50 engages progressively between the exterior of the case E and the front panel 3, resulting in a slight separation between the case E and the front face of the box B. This separation substantially corresponds to the thickness of the board of the flap 40.

As a result, the flap 40 may be immobilized by being gripped between the inside face of the front panel 3 and the corresponding portion of the case E. In addition, as mentioned earlier, the tongues 21*c*, 22*c* engage with the edges of the incisions 40*a*, 40*b* of the lid part 37.

FIG. 3 shows an example of a blank F made from a single sheet, e.g., board, from which the box B described above may be produced by successive folding of the different parts and pasting.

The following is an example of how the box B may be formed: after folding the panels 3, 4, 5, 6 along the lines 10 to 12 and pasting the lip 7 to an area situated on a free edge 10*a* of the panel 5, a sheath 2 of generally parallelepiped exemplary shape is obtained. This sheath 2 has two open ends 15, 15'. Each of the side panels 5 and 6 may be provided with two tabs 21, 22 and 21', 22' connected to the respective ends of the side panels 5, 6 by fold lines 21*a*, 22*a* and 21*a'*, 22*a'*, respectively. The sheath 2 may then be opened out.

In order to close the bottom 15' of the sheath 2, for example, the tabs 21' and 22' may be folded over, and then the lid part 37' may be folded along the first fold line 38'. Next, the flap 40' may be folded along the second fold line 39' and inserted into the sheath 2, at the bottom end 15' of the sheath 2.

Following closure of the bottom end 15', the sheath 2 is ready to accept the case E to be packaged, as shown in FIG. 1. In the example considered, the case E is introduced into the sheath through 2 the top end 15.

In a similar way, the top end 15 may be closed by folding the tabs 21 and 22 over. Next, the lid part 37 may be folded along the fold line 38. The flap 40 may be folded along the fold line 39 and inserted into the sheath 2 at the end 15.

As a result, the case E may be immobilized during transport and storage, substantially eliminating any rattling about inside box B.

It should be noted that in an optional process, box B is produced, the object E is inserted into box B, and box B is closed by means of an appropriate industrial tool. Alternatively, the box B could be formed around the object E, without a separate insertion of the object E in the box B.

The invention is not limited to the embodiment described above.

Figure 4:
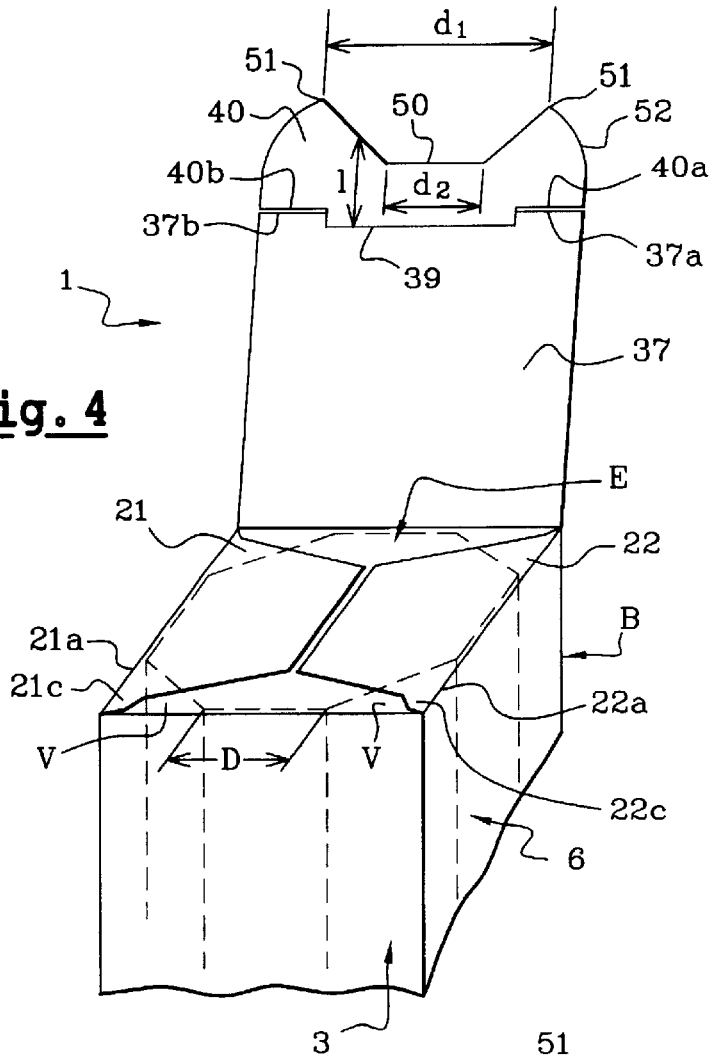
FIG. 4 is a partial schematic perspective view of another optional embodiment of a packaging system.

FIG. 4 illustrates another optional exemplary embodiment that differs from the embodiment described above in that the cross section of the object E may be octagonal, and the indentation 50 of the flap 40 may be trapezoidal in form, being wider at its free edge. The gap between the extensions 51 may have a width $d_1$, while the small base of the trapezium may have a width $d_2$. As a function of the width of the contact area D, $d_1$ and $d_2$ may be chosen in such a way that the following relationships are satisfied:

$$d_1>D, \text{ and } d_1>d_2.$$

Given these conditions, it may be easy to insert the flap 40 between the case E and the internal face of the front panel 3.

Figure 5:
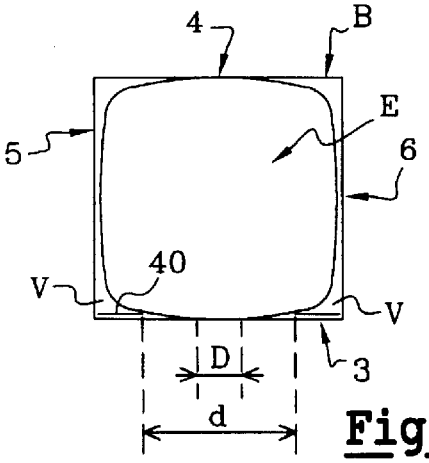
FIG. 5 is a schematic top view of an additional optional embodiment of a packaging system.

FIG. 5 illustrates a top view, similar to FIG. 2, of another optional exemplary embodiment of the assembly 1. The exemplary object E depicted in FIG. 5, for example, has a cross section of essentially square shape, with rounded corners. The side walls of the object E are slightly convex, with a relatively large radius of curvature. As a function of this radius of curvature, the contact area D between the object E and the internal wall of the front panel 3, may be wider than the contact area illustrated in FIGS. 1 and 2. The closing mechanism of the box B is essentially the same as that described with reference to box B seen in FIGS. 1 and 2.

Figure 6:
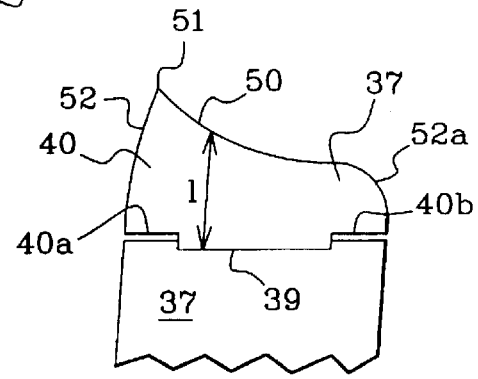
FIG. 6 is a partial schematic perspective view of yet another optional embodiment.

FIG. 6 illustrates yet another optional exemplary embodiment of the configuration of the flap 40. In this optional embodiment, the lid part 37 has only one extension 51, formed in the vicinity of a side edge 52 of the flap, and is designed to come into engagement with only one of the volumes V defined on either side of the contact area D. The side edge 52 of the flap 40 adjacent to the extension 51 may be slightly convex. The width of the flap 50 from the extension 51 may decrease progressively along a curved outline in the direction of the incision 40*b*. The curvature may be initially concave adjacent to the extension 51, prior to becoming convex at 52*a* adjacent to the incision 40*b*. The closure mechanism of the box B may be essentially the same as that described with reference to box B seen in FIGS. 1 and 2.

The objects according to the optional aspects of the invention contain any make-up or care products, such as cosmetic, dermatological, or pharmaceutical compositions used for treating hair, skin, lips, or nails. However, in its broadest aspects, the present invention could be used to package many other objects and substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics of the box or packaging system.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. An object packaging system comprising:

a box comprising a front panel defining a width, a rear panel, two side panels connecting the front panel to the rear panel, and at least one opening;

an object contained within the box, the object having a cross-section substantially contacting the front panel adjacent the opening only at a contact portion defined by a portion of the width of the front panel; and a closing system associated with the opening, the closing system comprising a lid part defined by a folded continuation portion of the rear panel, wherein the lid part is configured to fold down over the opening when placed in a closed position, and a flap defined by a folded portion of the lid part, the flap being configured to be positioned between the object and the front panel when the lid part is in the closed position, wherein the flap has a free edge having an outline configured to assist with interpositioning the flap between the object and the contact portion.

2. The object packaging system of claim 1, wherein the free edge forms at least one extension configured to fit into a space formed between the object and the front panel and defined on at least one side of the contact portion, the extension being adjacent an edge portion defined by a progressively changing distance from the lid part, wherein the edge portion is configured to progressively engage the object as the lid part is closed, and to further assist with the interpositioning of the flap between the object and the front panel.

3. The object packaging system of claim 1, wherein the object is substantially in contact with the front panel at only a central portion of the front panel and the free edge forms two extensions separated by a distance greater than the width of the contact portion.

4. The object packaging system of claim 1, wherein the cross-section of the object comprises at least one portion of an arc of a circle, the object being configured to be positioned in tangential contact with the front panel.

5. The object packaging system of claim 1, wherein the cross-section of the object is one of circular, oval, hexagonal, octagonal, and polygonal.

6. The object packaging system of claim 3, wherein the two extensions are separated by an indentation having the form of one of a V-shape, a trapezium, and an arc.

7. The object packaging system of claim 6, wherein the free edge has an outline that extends progressively in a direction facing away from the lid part and toward an apex of each extension.

8. The object packaging system of claim 7, wherein the outline has convex shape.

9. The object packaging system of claim 1, wherein the closing system further comprises at least one side tab defined by a continuation of one of the side panels, wherein the flap is configured to be positioned between an edge of the side tab and the front panel when the lid part is in the closed position.

10. The object packaging system of claim 1, wherein the object is a case containing one of a make-up product and a care product.

11. The object packaging system of claim 10, wherein the case contains one of lipstick, foundation, and lip-care product.

12. The object packaging system of claim 1, wherein the box is formed from a sheet material.

13. The object packaging system of claim 1, wherein the box is formed from one of board, paper board, cardboard, and a paper-based material.

14. The object packaging system of claim 1, wherein the free edge forms one extension configured to fit into a space formed between the object and the front panel, the wherein the free edge curves progressively from a convex configuration to a concave configuration.

15. The object packaging system of claim 1, further comprising:

a second opening; and a second closing system associated with the second opening, the second closing system comprising a second lid part defined by a folded continuation portion of one of the panels, wherein the second lid part is configured to fold down over the second opening when placed in a closed position, and a second flap defined by a folded portion of the second lid part, the second flap being configured to be positioned between the object and one of the panels when the second lid part is in the closed position, wherein the second flap has a free edge having an outline configured to assist with interpositioning the second flap between the object and one of the panels.

16. The object packaging system of claim 15, wherein the second lid part is defined by a folded continuation portion of the rear panel and the second flap has a free edge having an outline configured to assist with interpositioning the second flap between the object and the front panel.

17. A method of packaging an object comprising:

providing the object packaging system of claim 1; and inserting the flap between the object and the contact portion.

18. The method of claim 17, wherein the object is a case containing one of a make-up product and a care product.

19. The method of claim 18, wherein the case contains one of lipstick, foundation, and lip-care product.

20. A method of packaging an object comprising:

providing the object packaging system of claim 15;

inserting the flap between the object and the contact portion;

inserting the second flap between the object and one of the panels.

21. A box for packaging an object, the box comprising:

a front panel defining a width;

a rear panel;

side panels connecting the front panel to the rear panel;

at least one opening; and a closing system associated with the opening, the closing system comprising a lid part defined by a folded continuation portion of the rear panel, wherein the lid part is configured to fold down over the opening when placed in a closed position, and a flap defined by an uninterrupted fold line extending through at least a portion of the lid part located centrally between opposite sides of the lid part, the flap being configured to be positioned between the object and the front panel when the lid part is in the closed position, and wherein the flap has a free edge having an outline configured to assist with interpositioning the flap between the object and the front panel.

22. The box of claim 21, wherein the free edge forms at least one extension configured to fit into a space formed between the object and the front panel and defined on at least one side of a portion of the front panel where the object substantially contacts the front panel when contained within the box, the extension being adjacent an edge portion defined by a progressively changing distance from the lid part, wherein the edge portion is configured to progressively engage the object as the lid part is closed, and further to assist with interpositioning the flap between the object and the front panel.

23. The box of claim 21, wherein the free edge forms two extensions separated by a distance configured to be greater than a width defined by a contact portion between the object and the front panel when the object is contained within the box.

24. The box of claim 23, wherein the two extensions are separated by an indentation having the form of one of a V-shape, a trapezium, and an arc.

25. The box of claim 23, wherein the free edge has an outline that extends progressively in a direction facing away from the lid part and toward an apex of each extension.

26. The box of claim 25, wherein the outline has convex shape.

27. The box of claim 21, wherein the closing system further comprises at least one side tab defined by a continuation of one of the side panels, wherein the flap is configured to be positioned between an edge of the side tab and the front panel when the lid part is in the closed position.

28. The box of claim 21, wherein the box is formed from a sheet material.

29. The box of claim 21, wherein the box is formed from one of board, paper board, cardboard, and a paper-based material.

30. The box of claim 21, wherein the free edge forms one extension configured to fit into a space formed between the object and the front panel, the wherein the free edge curves progressively from a convex configuration to a concave configuration.

31. The box of claim 21, further comprising:

a second opening; and a second closing system associated with the second opening, the second closing system comprising a second lid part defined by a folded continuation portion of one of the panels, wherein the second lid part is configured to fold down over the second opening when placed in a closed position, and a second flap defined by a folded portion of the second lid part, the second flap being configured to be positioned between the object and one of the panels when the second lid part is in the closed position, wherein the second flap has a free edge having an outline configured to assist with interpositioning the second flap between the object and one of the panels.

32. The box of claim 31, wherein the second lid part is defined by a folded continuation portion of the rear panel and the second flap has a free edge having an outline configured to assist with interpositioning the second flap between the object and the front panel.

33. An object packaging system comprising:

the box of claim 21; and an object contained within the box, wherein the object has a cross-section substantially contacting the front panel adjacent the opening only at a contact portion defined by a portion of the width of the front panel.

34. The object packaging system of claim 33, wherein the cross-section of the object comprises at least one portion of an arc of a circle configured to be positioned in tangential contact with the front panel.

35. The object packaging system of claim 33, wherein the cross-section of the object is one of circular, oval, hexagonal, octagonal, and polygonal.

36. The object packaging system of claim 33, wherein the object is a case containing one of a make-up product and a care product.

37. The object packaging system of claim 36, wherein the case contains one of lipstick, foundation, and lip-care product.

38. An object packaging system comprising:

the box of claim 31; and an object contained within the box, wherein the object has a cross-section substantially contacting the front panel adjacent the opening only at a contact portion defined by a portion of the width of the front panel.

39. A method of packaging an object comprising:

providing the box of claim 21, wherein the box contains an object; and inserting the flap between the object and the front panel.

40. The method of claim 39, wherein the object is a case containing one of a make-up product and a care product.

41. The method of claim 40, wherein the case contains one of lipstick, foundation, and lip-care product.

42. A method of packaging an object comprising: providing the object packaging system of claim 38;

inserting the flap between the object and the contact portion; and inserting the second flap between the object and one of the panels.

43. A box for packaging an object, the box comprising:

a front panel defining a width;

a rear panel;

side panels connecting the front panel to the rear panel;

at least one opening; and a closing system associated with the opening, the closing system comprising a lid part defined by a folded continuation portion of the rear panel, wherein the lid part is configured to fold down over the opening when placed in a closed position, a flap defined by a folded portion of the lid part, the flap being configured to be positioned between the object and the front panel when the lid part is in the closed position, and wherein the flap has a free edge having an outline configured to assist with interpositioning the flap between the object and the front panel, and at least one side tab defined by a continuation of one of the side panels and a fold line, the side tab having a side edge extending between the fold line and a terminal edge of the side tab, wherein the side edge is configured to be spaced from the front panel adjacent the terminal edge when the side tab is placed in a closed position, and wherein the flap is configured to be positioned between the side edge of the side tab and the front panel when the lid is in the closed position.

44. The box of claim 43, wherein the at least one side flap comprises two side flaps, and each of the side flaps is defined by a continuation of one of the side panels and a fold line.

45. The box of claim 43, wherein the free edge forms at least one extension configured to fit into a space formed between the object and the front panel and defined on at least one side of a portion of the front panel where the object substantially contacts the front panel when contained within the box, the extension being adjacent an edge portion defined by a progressively changing distance from the lid part, wherein the edge portion is configured to progressively engage the object as the lid part is closed, and to assist with interpositioning the flap between the object and the front panel.

46. The box of claim 45, wherein the free edge forms two extensions separated by a distance configured to be greater than a width defined by a contact portion between the object and the front panel when the object is contained within the box.

47. The box of claim 46, wherein the two extensions are separated by an indentation having the form of one of a V-shape, a trapezium, and an arc.

48. The box of claim 46, wherein the free edge has an outline that extends progressively in a direction facing away from the lid part and toward an apex of each extension.

49. The box of claim 48, wherein the outline has convex shape.

50. The box of claim 43, wherein the box is formed from a sheet material.

51. The box of claim 43, wherein the box is formed from one of board, paper board, cardboard, and a paper-based material.

52. The box of claim 43, wherein the free edge forms one extension configured to fit into a space formed between the object and the front panel, the wherein the free edge curves progressively from a convex configuration to a concave configuration.

53. The box of claim 43, further comprising:

a second opening; and a second closing system associated with the second opening, the second closing system comprising a second lid part defined by a folded continuation portion of one of the panels, wherein the second lid part is configured to fold down over the second opening when placed in a closed position, and a second flap defined by a folded portion of the second lid part, the second flap being configured to be positioned between the object and one of the panels when the second lid part is in the closed position, wherein the second flap has a free edge having an outline configured to assist with interpositioning the second flap between the object and one of the panels.

54. The box of claim 53, wherein the second lid part is defined by a folded continuation portion of the rear panel and the second flap has a free edge having an outline configured to assist with interpositioning the second flap between the object and the front panel.

55. An object packaging system comprising:

the box of claim 43; and an object contained within the box, wherein the object has a cross-section substantially contacting the front panel adjacent the opening only at a contact portion defined by a portion of the width of the front panel.

56. The object packaging system of claim 55, wherein the cross-section of the object comprises at least one portion of an arc of a circle configured to be positioned in tangential contact with the front panel.

57. The object packaging system of claim 55, wherein the cross-section of the object is one of circular, oval, hexagonal, octagonal, and polygonal.

58. The object packaging system of claim 55, wherein the object is a case containing one of a make-up product and a care product.

59. The object packaging system of claim 58, wherein the case contains one of lipstick, foundation, and lip-care product.

60. An object packaging system comprising:

the box of claim 53; and an object contained within the box, wherein the object has a cross-section substantially contacting the front panel adjacent the opening only at a contact portion defined by a portion of the width of the front panel.

61. A method of packaging an object comprising:

providing the box of claim 43, wherein the box contains an object; and inserting the flap between the object and the front panel such that the flap is positioned between the side flap and the front panel.

62. The method of claim 61, wherein the object is a case containing one of a make-up product and a care product.

63. The method of claim 62, wherein the case contains one of lipstick, foundation, and lip-care product.

64. A method of packaging an object comprising: providing the object packaging system of claim 60;

inserting the flap between the object and the contact portion; and inserting the second flap between the object and one of the panels.

* * * * *

UNITED STATES PATENT AND TRADEMARK OFFICE

CERTIFICATE OF CORRECTION

PATENT NO. : 6,702,117 B1
DATED : March 9, 2004
INVENTOR(S) : Jean-François Hould It is certified that error appears in the above-identified patent and that said Letters Patent is hereby corrected as shown below:

Column 9,
Line 53, after “panel,” and before “wherein”, delete “the”;

Column 11,
Line 15, after “panel,” and before “wherein”, delete “the”;

Column 13,
Line 6, after “panel,” and before “wherein”, delete “the”.

Signed and Sealed this

Twenty-second Day of June, 2004

JON W. DUDAS
*Acting Director of the United States Patent and Trademark Office*